US007384443B2

(12) United States Patent
Mirchandani

(10) Patent No.: US 7,384,443 B2
(45) **Date of Patent: *Jun. 10, 2008**

(54) HYBRID CEMENTED CARBIDE COMPOSITES

(75) Inventor: Prakash K. Mirchandani, Hampton Cove, AL (US)

(73) Assignee: TDY Industries, Inc., Pittsburgh, PA (US)

( * ) Notice: Subject to any disclaimer, the term of this patent is extended or adjusted under 35 U.S.C. 154(b) by 503 days.

This patent is subject to a terminal disclaimer.

(21) Appl. No.: 10/735,379

(22) Filed: Dec. 12, 2003

(65) Prior Publication Data

US 2005/0126334 A1 Jun. 16, 2005

(51) Int. Cl.
*C22C 29/06* (2006.01)

(52) U.S. Cl. ..... 75/236; 75/240

(58) Field of Classification Search ..... 75/236, 75/240

See application file for complete search history.

(56) References Cited

U.S. PATENT DOCUMENTS

| | | | | |
|---|---|---|---|---|
| 3,660,050 | A | 5/1972 | Iler et al. | |
| 3,757,879 | A | 9/1973 | Wilder et al. | |
| 4,017,480 | A | 4/1977 | Baum | |
| 4,389,952 | A | 6/1983 | Dreier et al. | |
| 4,743,515 | A * | 5/1988 | Fischer et al. | 428/698 |
| 4,923,512 | A | 5/1990 | Timm et al. | |
| 4,956,012 | A | 9/1990 | Jacobs et al. | |
| 5,281,260 | A | 1/1994 | Kumar et al. | |

(Continued)

FOREIGN PATENT DOCUMENTS

AU 695583 2/1998

(Continued)

OTHER PUBLICATIONS

U.S. Appl. No. 11/206,368, filed Aug. 18, 2005 (65 pages).

*Primary Examiner*—George Wyszomierski
(74) *Attorney, Agent, or Firm*—Kirkpatrick & Lockhart Preston Gates Ellis LLP; Patrick J. Viccaro

(57) ABSTRACT

Embodiments of the present invention include hybrid composite materials comprising a cemented carbide dispersed phase and a cemented carbide continuous phase. The contiguity ratio of the dispersed phase of embodiments may be less than or equal to 0.48. The hybrid composite material may have a hardness of the dispersed phase that is greater than the hardness of the continuous phase. For example, in certain embodiments of the hybrid composite material, the hardness of the dispersed phase is greater than or equal to 88 HRA and less than or equal to 95 HRA and the hardness of the continuous phase is greater than or equal to 78 and less than or equal to 91 HRA.

Additional embodiments may include hybrid composite materials comprising a first cemented carbide dispersed phase wherein the volume fraction of the dispersed phase is less than 50 volume percent and a second cemented carbide continuous phase, wherein the contiguity ratio of the dispersed phase is less than or equal to 1.5 times the volume fraction of the dispersed phase in the composite material.

The present invention also includes a method of making a hybrid cemented carbide composite by blending partially and/or fully sintered granules of the dispersed cemented carbide grade with "green" and/or unsintered granules of the continuous cemented carbide grade to provide a blend. The blend may then be consolidated to form a compact. Finally, the compact may be sintered to form a hybrid cemented carbide.

22 Claims, 7 Drawing Sheets

U.S. PATENT DOCUMENTS

| | | | |
|---|---|---|---|
| 5,348,806 | A | 9/1994 | Kojo et al. |
| 5,482,670 | A | 1/1996 | Hong |
| 5,484,468 | A | 1/1996 | Östlund et al. |
| 5,543,235 | A | 8/1996 | Mirchandani et al. |
| 5,593,474 | A | 1/1997 | Keshavan et al. |
| 5,612,264 | A | 3/1997 | Nilsson et al. |
| 5,677,042 | A | 10/1997 | Massa et al. |
| 5,679,445 | A | 10/1997 | Massa et al. |
| 5,697,046 | A | 12/1997 | Conley |
| 5,733,649 | A | 3/1998 | Kelley et al. |
| 5,733,664 | A | 3/1998 | Kelley et al. |
| 5,776,593 | A | 7/1998 | Massa et al. |
| 5,778,301 | A | 7/1998 | Hong |
| 5,789,686 | A | 8/1998 | Massa et al. |
| 5,806,934 | A | 9/1998 | Massa et al. |
| 5,830,256 | A | 11/1998 | Northrop et al. |
| 5,856,626 | A | 1/1999 | Fischer et al. |
| 5,880,382 | A | 3/1999 | Fang et al. |
| 6,086,980 | A | 7/2000 | Foster et al. |
| 6,089,123 | A | 7/2000 | Chow et al. |
| 6,209,420 | B1 | 4/2001 | Butcher et al. |
| 6,214,287 | B1 | 4/2001 | Waldenström |
| 6,220,117 | B1 | 4/2001 | Butcher |
| 6,228,139 | B1 | 5/2001 | Oskarrson |
| 6,254,658 | B1 | 7/2001 | Taniuchi et al. |
| 6,287,360 | B1 | 9/2001 | Kembaiyan et al. |
| 6,290,438 | B1 | 9/2001 | Papajewski |
| 6,293,986 | B1 | 9/2001 | Rödiger et al. |
| 6,511,265 | B1 | 1/2003 | Mirchandani et al. |
| 6,685,880 | B2 | 2/2004 | Engström et al. |
| 2004/0060742 | A1 | 4/2004 | Kembaiyan et al. |
| 2005/0126334 | A1 | 6/2005 | Mirchandani |
| 2005/0211475 | A1 | 9/2005 | Mirchandani et al. |
| 2005/0247491 | A1 | 11/2005 | Mirchandani et al. |
| 2006/0131081 | A1 | 6/2006 | Mirchandani et al. |

FOREIGN PATENT DOCUMENTS

| | | |
|---|---|---|
| CA | 2212197 | 10/2000 |
| EP | 0453428 A1 | 10/1991 |
| EP | 1244531 B1 | 10/2004 |
| GB | 945227 | 12/1963 |
| GB | 2393449 A | 3/2004 |
| JP | 10 219385 | 8/1998 |
| WO | WO 03/049889 A2 | 6/2003 |

* cited by examiner

HYBRID CEMENTED CARBIDE COMPOSITES

BACKGROUND OF THE TECHNOLOGY

Field of Technology

The present disclosure relates to hybrid cemented carbide composites and methods of making hybrid cemented carbide composites. Embodiments of the hybrid cemented carbide composites may be used in any application that conventional cemented carbides are used, but additionally may be used in applications requiring improved toughness and wear resistance than conventional cemented carbides, such as, but not limited to, the cutting elements of drill bits used for oil and gas exploration, rolls for hot rolling of metals, etc.

DESCRIPTION OF THE BACKGROUND OF THE TECHNOLOGY

Conventional cemented carbides are composites of a metal carbide hard phase dispersed throughout a continuous binder phase. The dispersed phase, typically, comprises grains of a carbide of one or more of the transition metals, for example, titanium, vanadium, chromium, zirconium, hafnium, molybdenum, niobium, tantalum and tungsten. The binder phase, used to bind or "cement" the metal carbide grains together, is generally at least one of cobalt, nickel, iron or alloys of these metals. Additionally, alloying elements such as chromium, molybdenum, ruthenium, boron, tungsten, tantalum, titanium, niobium, etc. may be added to enhance different properties. Various cemented carbide grades are produced by varying at least one of the composition of the dispersed and continuous phases, the grain size of the dispersed phase, volume fractions of the phases, as well as other properties. Cemented carbides based on tungsten carbide as the dispersed hard phase and cobalt as the binder phase are the most commercially important among the various metal carbide-binder combinations available.

Cemented carbide grades with tungsten carbide in a cobalt binder have a commercially attractive combination of strength, fracture toughness and wear resistance. "Strength" is the stress at which a material ruptures or fails. "Fracture toughness" is the ability of a material to absorb energy and deform plastically before fracturing. Toughness is proportional to the area under the stress-strain curve from the origin to the breaking point. See McGraw-Hill Dictionary of Scientific and Technical Terms ($5^{th}$ ed. 1994). "Wear resistance" is the ability of a material to withstand damage to its surface. Wear generally involves progressive loss of material, due to a relative motion between a material and a contacting surface or substance. See Metals Handbook Desk Edition (2d ed. 1998).

The strength, toughness and wear resistance of a cemented carbide are related to the average grain size of the dispersed hard phase and the volume (or weight) fraction of the binder phase present in the conventional cemented carbide. Generally, an increase in the average grain size of tungsten carbide and/or an increase in the volume fraction of the cobalt binder will result in an increase in fracture toughness. However, this increase in toughness is generally accompanied by a decrease in wear resistance. The cemented carbide metallurgist is thus challenged to develop cemented carbides with both high wear resistance and high fracture toughness while attempting to design grades for demanding applications.

FIG. 1 illustrates the relationship that exists between fracture toughness and wear resistance in conventional cemented carbide grades comprising tungsten carbide and cobalt. The fracture toughness and wear resistance of a particular conventional cemented carbide grade will typically fall in a narrow band enveloping the solid trend line 1 shown.

As FIG. 1 shows, cemented carbides may generally be classified in at least two groups: (i) relatively tough grades shown in Region I; and (ii) relatively wear resistant grades shown in Region II. Generally, the wear resistant grades of Region II are based on relatively small tungsten carbide grain sizes (typically about 2 μm and below) and cobalt contents ranging from about 3 weight percent up to about 15 weight percent. Grades such as those in Region II are most often used for tools for cutting, and forming metals and other materials due to their ability to hold a sharp cutting edge as well as their high levels of wear resistance.

Conversely, the relatively tough grades of Region I are generally based on relatively coarse tungsten carbide grains (typically about 3 μm and above) and cobalt contents ranging from about 6 weight percent up to about 30 weight percent. Grades based on coarse tungsten carbide grains find extensive use in applications where the material experiences shock and impact and also may undergo abrasive wear and thermal fatigue. Common applications for coarse-grained grades include tools for mining and earth drilling, hot rolling of metals and impact forming of metals, e.g., cold heading.

FIG. 1 indicates that even making small improvements in wear resistance of the cemented carbide grades in Region I using conventional techniques results in a large decrease in fracture toughness. Therefore, there is a need for new techniques to increase wear resistance of cemented carbide grades within Region I without significantly sacrificing toughness.

Within certain limits, the wear resistance of a cemented carbide is more closely linked to the amount of hard phase content than to hard phase grain size. Thus, a logical way to obtain improved toughness at a given level of wear resistance is to increase the hard phase tungsten carbide grain size at a given cobalt content. In fact, this has been the most common approach employed while designing grades for applications where abrasion, as well as, shock, impact and/or thermal fatigue are present. However, there are practical limits to the manufacture of the tungsten carbide grain sizes. In addition, large tungsten carbide grains, because of their inherent brittle nature, tend to crack and fracture when subjected to abrasive wear. Thus, while the rate of abrasive wear is essentially independent of tungsten carbide grain size below a certain size level, the observed rate of abrasive wear can dramatically increase when the tungsten carbide grain size exceeds a certain optimum size. Therefore, while increasing the tungsten carbide grain size at any given cobalt content is one technique that may provide improved toughness at a given wear resistance level, the practical utility of this method is limited.

Another technique used to improve the properties of cemented carbides is described in U.S. Pat. No. 4,956,012. This patent describes a method of manufacturing a composite of two cemented carbide grades that exhibits properties that are intermediate to the properties of the individual cemented carbides. The method of producing the composite cemented carbides consists of dry blending unsintered or green granules of one cemented carbide grade with the unsintered or green granules of a different cemented carbide grade, followed by consolidation and sintering using conventional means. Improvements in properties are realized by this method, however, the unsintered granules of the cemented carbide grades collapse during the powder consolidation, typically by a powder pressing operation, resulting in a microstructure of the final material consisting of one cemented carbide grade intermeshed within the other grade. See FIGS. 2, 4A, and 5A. This technique limits the ability to control the shape of the regions of either of the grades. Due to the absence of any control of the microstructure in these composite cemented carbides, cracks once started may easily propagate through the continuous paths of the hard grade. Thus, these composites tend to chip and break and the fracture toughness of the bulk composite is not significantly higher than the fracture toughness of the phase of the cemented carbide with the lowest fracture toughness, typically the hard phase. The composite of FIG. 2 produced by the method of U.S. Pat. No. 4,956,012 has a volume fraction of the harder phase of 0.30 and a hard phase contiguity ratio calculated to be about 0.52.

As indicated by the foregoing, a method of making a composite possessing strength, high fracture toughness and wear resistance, and without significantly compromising one of these properties to enhance another, would be highly advantageous.

SUMMARY

Embodiments of the present invention include hybrid cemented carbide composites comprising a cemented carbide dispersed phase and a second cemented carbide continuous phase. The contiguity ratio of the dispersed phase of embodiments may be less than or equal to 0.48. The hybrid cemented carbide composite may have a hardness of the dispersed phase that is greater than the hardness of the continuous phase. For example, in certain embodiments of the hybrid composite material, the hardness of the dispersed phase is greater than or equal to 88 HRA and less than or equal to 95 HRA and the hardness of the continuous phase is greater than or equal to 78 and less than or equal to 91 HRA.

Additional embodiments may include hybrid cemented carbide composites comprising a first cemented carbide dispersed phase wherein the volume fraction of the dispersed phase is less than 50 volume percent and a second cemented carbide continuous phase, wherein the contiguity ratio of the dispersed phase is less than or equal to 1.5 times the volume fraction of the dispersed phase in the composite material.

The present invention also includes a method of making hybrid cemented carbide composites by blending at least one of partially and fully sintered granules of the dispersed cemented carbide grade with at least one of green and unsintered granules of the continuous cemented carbide grade to provide a blend. The blend may then be consolidated to form a compact. Finally, the compact may be sintered to form the hybrid cemented carbide.

DESCRIPTION OF EMBODIMENTS OF THE INVENTION

Embodiments of the present invention include hybrid cemented carbide composites and methods of forming hybrid cemented carbide composites (or simply "hybrid cemented carbides"). Whereas, a cemented carbide is a composite material, typically, comprising a metal carbide dispersed throughout a continuous binder phase, a hybrid cemented carbide may be one cemented carbide grade dispersed throughout a second cemented carbide continuous phase, thereby forming a composite of cemented carbides. The metal carbide hard phase of each cemented carbide, typically, comprises grains of a carbide of one or more of the transition metals, for example, titanium, vanadium, chromium, zirconium, hafnium, molybdenum, niobium, tantalum and tungsten. The continuous binder phase, used to bind or "cement" the metal carbide grains together, is generally cobalt, nickel, iron or alloys of these metals. Additionally, alloying elements such as chromium, molybdenum, ruthenium, boron, tungsten, tantalum, titanium, niobium, etc. may be added to enhance different properties. The hybrid cemented carbides of the present invention have lower contiguity ratios than other hybrid cemented carbides and improved properties relative to other cemented carbides.

Figure 3:
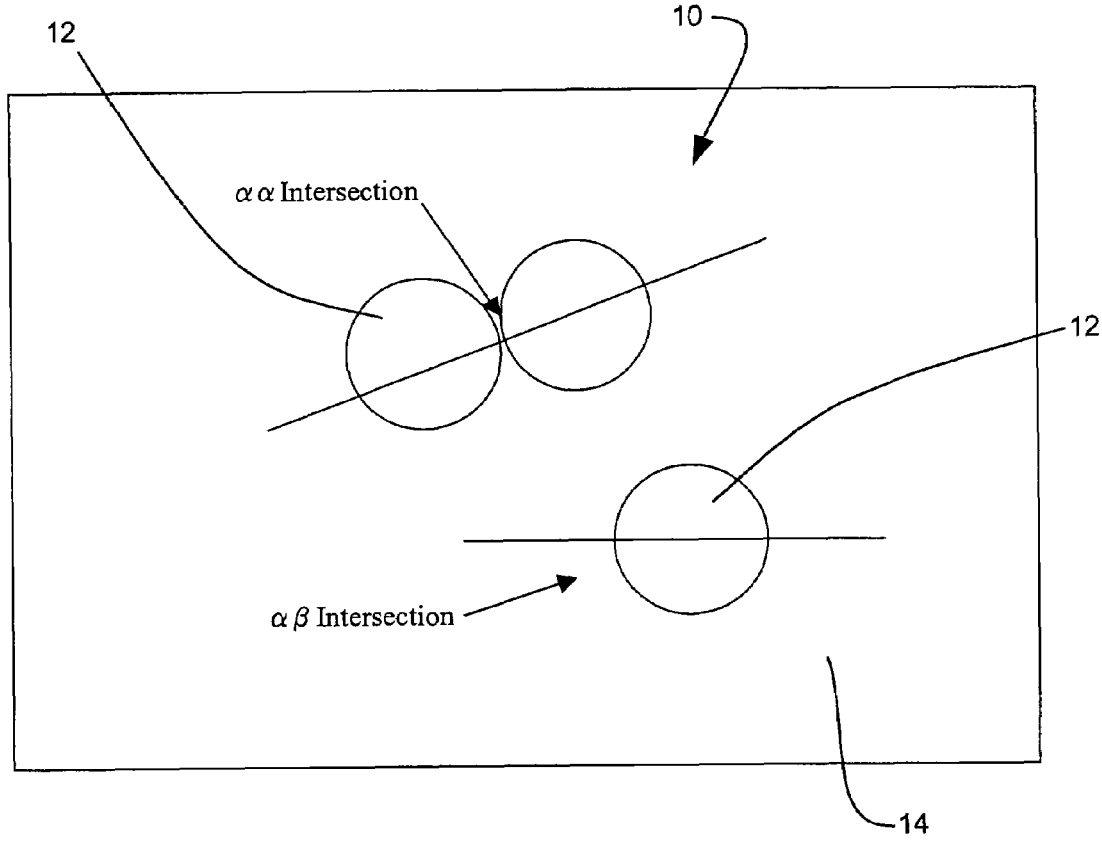
FIG. 3 is a graphical depiction of a method of a step in determining the contiguity ratio of a material comprising a dispersed phase and a continuous matrix phase.

Embodiments of the method of producing hybrid cemented carbides allows forming such materials with a low contiguity ratio of the dispersed cemented carbide phase. The degree of dispersed phase contiguity in composite structures may be characterized as the contiguity ratio, $C_t$. $C_t$ may be determined using a quantitative metallography technique described in Underwood, *Quantitative Microscope,* 279-290 (1968) hereby incorporated by reference. The technique consists of determining the number of intersections that randomly oriented lines of known length, placed on the microstructure as a photomicrograph of the material, make with specific structural features. The total number of intersections made by the lines with dispersed phase/dispersed phase intersections are counted ($N_{L\alpha\alpha}$), as are the number of intersections with dispersed phase/continuous phase interfaces ($N_{L\alpha\beta}$). FIG. 3 schematically illustrates the procedure through which the values for $N_{L\alpha\alpha}$ and $N_{L\alpha\beta}$ are obtained. In FIG. 3, 10 generally designates a composite including the dispersed phase 12 of α phase in a continuous phase 14, β. The contiguity ratio, $C_t$, is calculated by the equation $C_t=2N_{L\alpha\alpha}/(N_{L\alpha\beta}+2N_{L\alpha\alpha})$.

The contiguity ratio is a measure of the average fraction of the surface area of dispersed phase particles in contact with other dispersed first phase particles. The ratio may vary from 0 to 1 as the distribution of the dispersed particles changes from completely dispersed to a fully agglomerated structure. The contiguity ratio describes the degree of continuity of dispersed phase irrespective of the volume fraction or size of the dispersed phase regions. However, typically, for higher volume fractions of the dispersed phase, the contiguity ratio of the dispersed phase will also likely be higher.

In the case of hybrid cemented carbides having a hard cemented carbide dispersed phase, the lower the contiguity ratio the greater the chance that a crack will not propagate through contiguous hard phase regions. This cracking process may be a repetitive one with cumulative effects resulting a reduction in the overall toughness of the hybrid cemented carbide article, e.g., an earth-drilling bit. Replacing the cracked bit is both time-consuming and costly.

In certain embodiments, the hybrid cemented carbides may comprise between about 2 to about 40 vol. % of the cemented carbide grade of the dispersed phase. In other embodiments, the hybrid cemented carbides may comprise between about 2 to about 30 vol. % of the cemented carbide grade of the dispersed phase. In still further applications, it may be desirable to have between 6 and 25 volume % of the cemented carbide of the dispersed phase in the hybrid cemented carbide.

Figure 1:
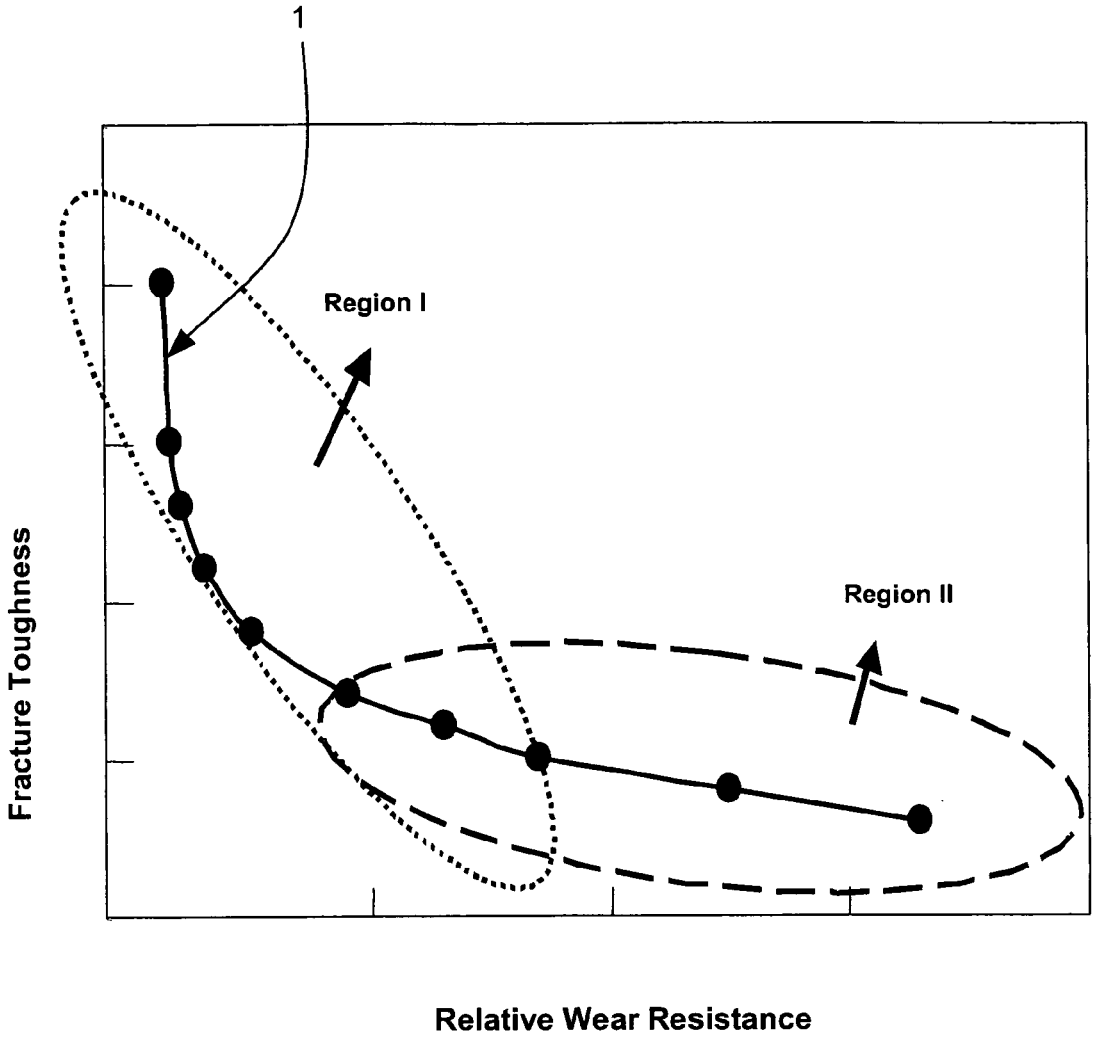
FIG. 1 is a graph depicting the relationship between fracture toughness and wear resistance in conventional cemented carbides.
Figure 4A:
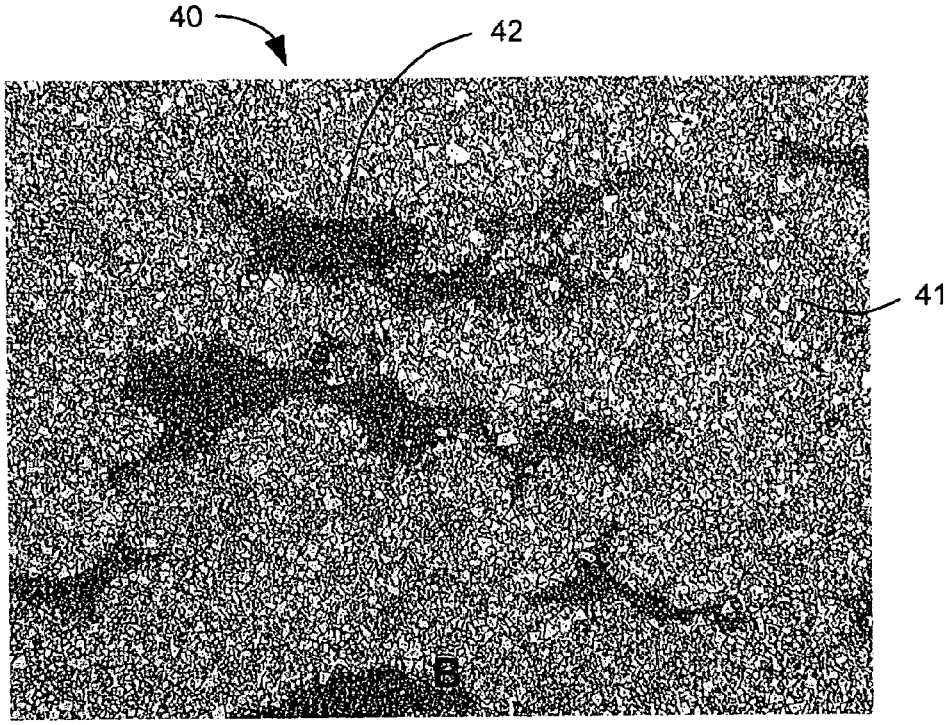
(Prior Art) Figure 4A
FIG. 4A is a photomicrograph of a hybrid cemented carbide produced by a method of the prior art having a volume fraction of the dispersed phase of 0.30 and a contiguity ratio of 0.50, the hybrid cemented carbide of FIG. 4A has a palmquist toughness of 12.8 $Mpa.m^{1/2}$.

Hybrid cemented carbides may be defined as a composite of cemented carbides, such as, but not limited to, a hybrid cemented carbide comprising a cemented carbide grade from Region I and a cemented carbide grade from Region II of FIG. 1 as discussed above. Embodiments of a hybrid cemented carbide have a continuous cemented carbide phase and a dispersed cemented carbide phase wherein the cemented carbide of the continuous phase has at least one property different than the cemented carbide of the dispersed phase. An example of a hybrid cemented carbide 40 is shown in FIG. 4A. The hybrid cemented carbide 40 produced by methods of the prior art of FIG. 4 has a continuous phase 41 of a commercially available cemented carbide sold as 2055™, a wear resistant cemented carbide with moderate hardness. 2055™ is a cemented carbide having a cobalt binder concentration of 10 wt. % and a tungsten carbide concentration of 90 wt. % with an average grain size of 4 μm to 6 μm. The resultant properties of 2055™ are a hardness of 87.3 HRA, a wear resistance of 0.93 10/mm$^3$, and a palmquist toughness of 17.4 Mpa.m$^{1/2}$, The hybrid cemented carbide 40 of FIG. 4A has a dispersed phase 42 of a commercially available cemented carbide sold as FK10F, a hard cemented carbide with high wear resistance. FK10F™ is a cemented carbide having a cobalt binder concentration of 6 wt. % and a tungsten carbide concentration of 94 wt. % with an average grain size of approximately 0.8 μm. The resultant properties of FK10F™ are a hardness of 93 HRA, a wear resistance of 6.6 10/mm$^3$, and a palmquist toughness of 9.5 Mpa.m$^{1/2}$.

The hybrid cemented carbide 40 was produced by simply blending 30 vol % of unsintered or "green" granules of one cemented carbide grade to form the dispersed phase with 70 vol. % of unsintered or "green" granules of another cemented carbide grade to form the continuous phase. The blend is then consolidated, such as by compaction, and subsequently sintered using conventional means. The resultant hybrid cemented carbide 40 has a hard phase contiguity ratio of 0.5 and a palmquist toughness of 12.8 Mpa.m$^{1/2}$. As can be seen in FIG. 4A, the unsintered granules of the dispersed phases collapse in the direction of powder compaction resulting in the connections being formed between the domains of the dispersed phase 42. Therefore, due to the connections of the dispersed phase, the resultant hybrid cemented carbide has a hard phase contiguity ratio of approximately 0.5. The connections between the dispersed phase, allow cracks that begin in one dispersed domain to easily follow a continuous path through the hard dispersed phase 42 without being mitigated by running into the tougher continuous phase 41. Therefore, though the hybrid cemented carbide has some improvement in toughness the resulting hybrid cemented carbide has a toughness closer to the hard dispersed phase than the tougher continuous phase.

The present inventors have discovered a method of producing hybrid cemented carbides with improved properties. The method of producing a hybrid cemented carbide includes blending at least one of partially and fully sintered granules of the dispersed cemented carbide grade with at least one of green and unsintered granules of the continuous cemented carbide grade. The blend is then consolidated, and sintered using conventional means. Partial or full sintering of the granules of the dispersed phase results in strengthening of the granules (as compared to "green" granules). In turn, the strengthened granules of the dispersed phase will have an increased resistance to collapse during consolidating of the blend. The granules of the dispersed phase may be partially or fully sintered at temperatures ranging from about 400 to about 1300° C. depending on the desired strength of the dispersed phase. The granules may be sintered by a variety of means, such as, but not limited to, hydrogen sintering and vacuum sintering. Sintering of the granules may cause removal of lubricant, oxide reduction, densification, and microstructure development. The methods of partial or full sintering of the dispersed phase granules prior to blending result in a reduction in the collapse of the dispersed phase during blend consolidation.

Embodiments of this method of producing hybrid cemented carbides allows for forming hybrid cemented carbides with lower dispersed phase contiguity ratios. See FIGS. 4B and 5B. Since the granules of at least one cemented carbide are partially or fully sintered prior to blending, the sintered granules do not collapse during the consolidation after blending and the contiguity of the resultant hybrid cemented carbide is low. Generally speaking, the larger the dispersed phase cemented carbide granule size and the smaller the continuous cemented carbide phase granule size, the lower the contiguity ratio at any volume fraction of the hard grade. The embodiments of the hybrid cemented carbides shown in FIGS. 4B, 5B, 6A, 6B, and 6C were produced by first sintering the dispersed phase cemented carbide granules at about 1000° C.

EXAMPLE 1

Figure 2:
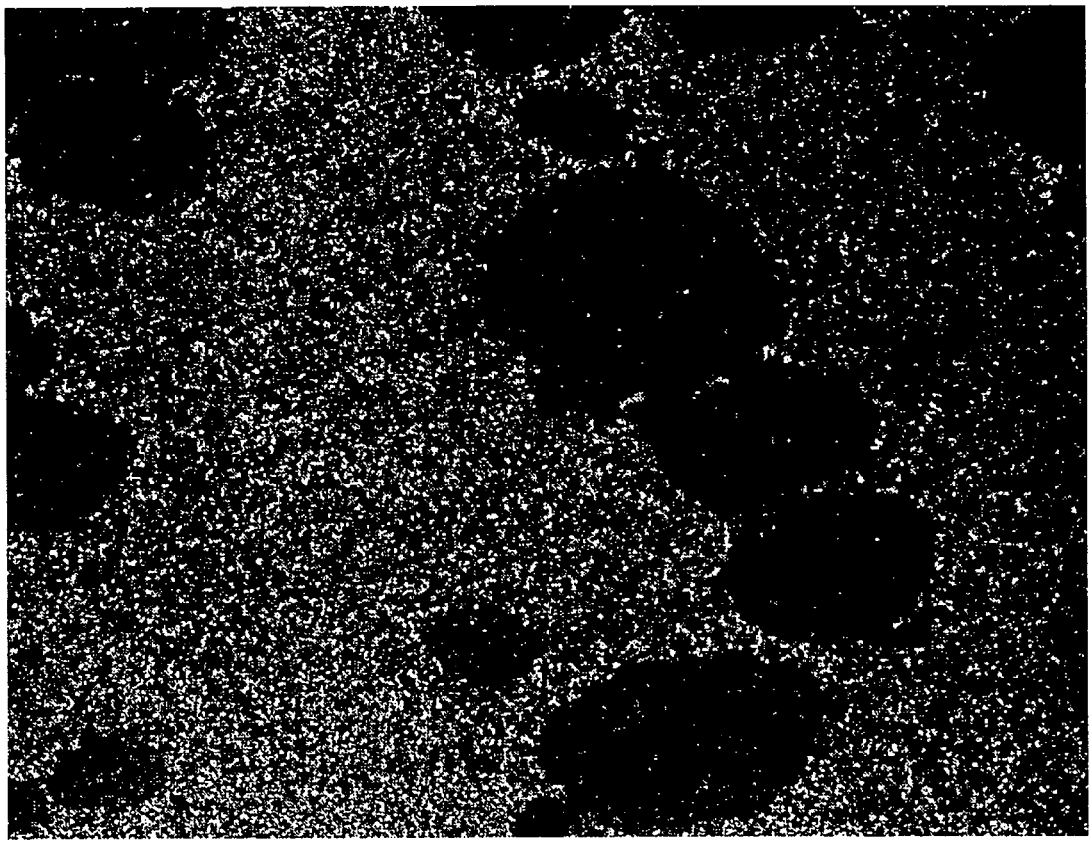
FIG. 2 is photomicrograph showing magnification at 100 diameters of a hybrid cemented carbide of the prior art.
Figure 4B:
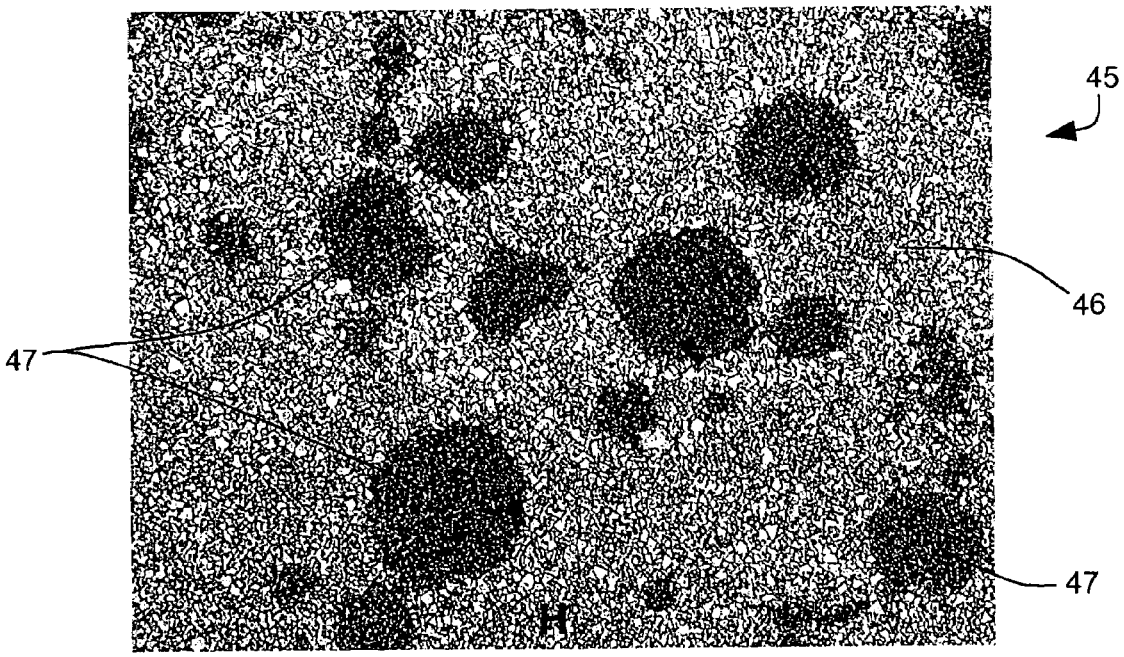
FIG. 4B is a photomicrograph of a hybrid cemented carbide produced by an embodiment of the method of the present invention having a volume fraction of the dispersed phase of 0.30 and a contiguity ratio of 0.31, the hybrid cemented carbide of FIG. 4B has a palmquist toughness of 15.2 $Mpa.m^{1/2}$.

A hybrid cemented carbide was prepared by the method of the present invention. See FIG. 4B. In the embodiment of the hybrid cemented carbide 45 shown in FIG. 4B, the continuous phase 46 is a tough crack resistant phase and the dispersed phase 47 is a hard wear resistant phase. The composition and the volume ratio of the two phases of the embodiment of FIG. 4B is the same as the hybrid cemented carbide of FIG. 4A, as described above. However, the method of producing the hybrid cemented carbide is different and the resultant difference in hybrid cemented carbide microstructure and properties are significant. Since the granules of the dispersed phase 47 were sintered prior to blending-the granules of the dispersed phase 47 did not collapse significantly upon consolidation of the blend, resulting in a contiguity ratio of the embodiment shown in FIG. 4B is 0.31. Significantly, the contiguity ratio of this embodiment is less than the contiguity ratios of the hybrid cemented carbides shown in FIGS. 2, and 4A that have a contiguity ratios of 0.52 and 0.5, respectively. The reduction in contiguity ratio has a significant effect on the bulk properties of the hybrid cemented carbide. The hardness of the embodiment of the hybrid cemented carbide shown in FIG. 4B is 15.2 Mpa. $m^{1/2}$, more than 18% increase over the hybrid cemented carbide shown in FIG. 4A. This is believed to be a result of the lower number of interconnections between the dispersed phase regions and, therefore, crack propagation that begins in any of the hard dispersed phase regions 47 would be aborted by the tougher continuous phase 46. The method of the present invention allows for limiting the contiguity ratio of a hybrid cemented carbide to less than 1.5 times the volume fraction of the dispersed phase in the hybrid cemented carbide, in certain applications it may be advantageous to limit the contiguity ratio of the hybrid cemented carbide to less than the 1.2 times the volume fraction of the dispersed phase.

EXAMPLE 2

Figure 5A:
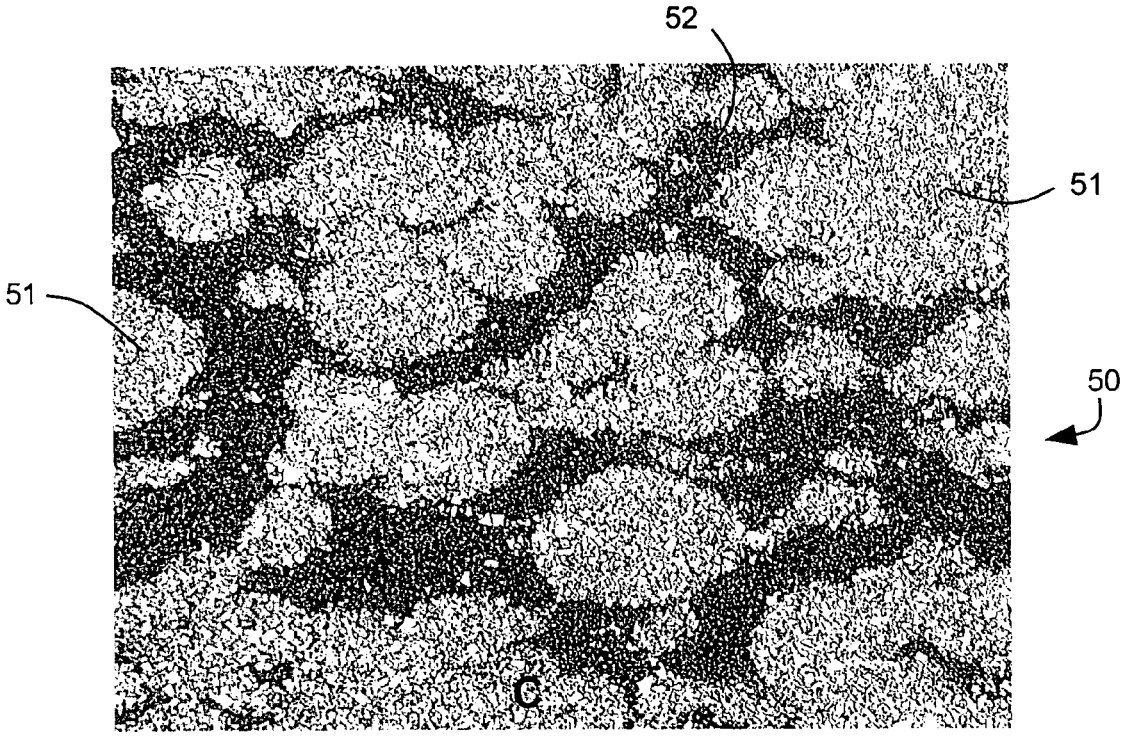
(Prior Art) Figure 5A
FIG. 5A is a photomicrograph of a hybrid cemented carbide produced by a method of the prior art having a volume fraction of the dispersed phase of 0.45 and a contiguity ratio of 0.75, the hybrid cemented carbide of FIG. 5A has a palmquist toughness of 10.6 $Mpa.m^{1/2}$.
Figure 5B:
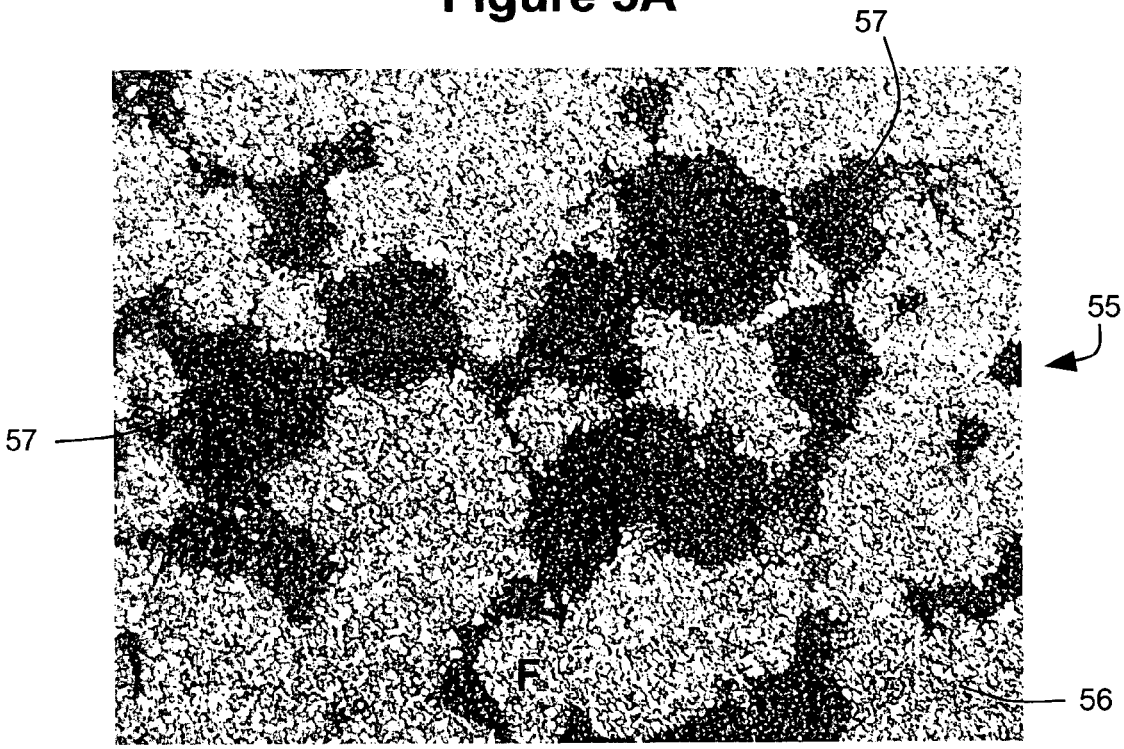
FIG. 5B is a photomicrograph of a hybrid cemented carbide produced by an embodiment of the method of the present invention having a volume fraction of the dispersed phase of 0.45 and a contiguity of 0.48, the hybrid cemented carbide of FIG. 5B has a palmquist toughness of 13.2 $Mpa.m^{1/2}$.

A hybrid cemented carbide was prepared by the method of the present invention. Granules of a hard cemented carbide, FK10F™, were sintered at 1000° C. Sintered granules of the FK10F™ cemented carbide were blended with "green" or unsintered granules of $_{2055}$™ cemented carbide. The blend comprising the sintered and unsintered granules was then consolidated and sintered using conventional means. Powder consolidation using conventional techniques may be used, such as, mechanical or hydraulic pressing in rigid dies, as well as, wet-bag or dry-bag isostatic pressing. Finally, sintering at liquid phase temperature in conventional vacuum furnaces or at high pressures in a SinterHip furnace may be carried out. See FIG. 5B. In the embodiment of the hybrid cemented carbide 55 shown in FIG. 5B, the continuous phase 56 is a tough crack resistant phase and the dispersed phase 57 is a hard wear resistant phase. The composition and the volume ratio of the two phases of the embodiment of FIG. 5B, is the same as the hybrid cemented carbide of FIG. 5A, prepared by conventional methods as described above. The volume fraction of the dispersed phase of both hybrid cemented carbides of FIGS. 5A and 5B is 0.45. However, the method of producing the hybrid cemented carbide is different and the resultant difference in hybrid cemented carbide microstructure and properties are significant. Since the granules of the dispersed phase 57 were sintered prior to blending, the granules of the dispersed phase 57 did not collapse upon consolidation of the blend, resulting in a contiguity ratio of the embodiment of the hybrid cemented carbide shown in FIG. 5B of 0.48. Significantly, the contiguity ratio of this embodiment is less than the contiguity ratios of the hybrid cemented carbide shown in FIG. 5A that has a contiguity ratio of 0.75. The reduction in contiguity ratio has a significant effect on the bulk properties of the hybrid cemented carbide. The palmquist toughness of the embodiment of the hybrid cemented carbide shown in FIG. 5B is 13.2 Mpa. $m^{1/2}$, a 25% increase over the palmquist toughness of 10.6 Mpa. $m^{1/2}$, of the hybrid cemented carbide shown in FIG. 5A. This is again believed to be a result of the reduction in interconnection between the dispersed phase and, therefore, crack propagation that begins in the hard dispersed phase 57 would be aborted by the tougher continuous phase 56.

Several additional embodiments of the hybrid cemented carbides were prepared by the method of the present invention using commercially available cemented carbide grades, see Table 1. Each of these commercially available cemented carbide grades are available from the Firth Sterling division of Allegheny Technologies Corporation.

TABLE I

Properties of Commercially Available Cemented Carbide Grades

| Grade | Composition (wt. %) Co | Composition (wt. %) WC | Average WC Grain Size (μm) | Hardness (HRA) | Wear Resistance ($10/mm^3$) | Palmquist Toughness ($Mpa \cdot m^{1/2}$) |
|---|---|---|---|---|---|---|
| FK10F ™ | 6 | 94 | 0.8 | 93.0 | 6.6 | 9.5 |
| AF63 ™ | 6 | 94 | 4-6 | 90.0 | 1.43 | 13.2 |
| 2055 ™ | 10 | 90 | 4-6 | 87.3 | 0.93 | 17.4 |
| R-61 ™ | 15 | 85 | 3-5 | 85.9 | 0.73 | 22.7 |
| H-25 ™ | 25 | 75 | 3-5 | 82.2 | 0.5 | 35.5 |

It should be understood, however, that such grades are provided by way of example and are not exhaustive of the possible cemented carbides that may be used in the embodiments of the present invention for either the dispersed or continuous phases.

Two embodiments of the hybrid cemented carbides of the present invention were prepared with a dispersed phase of FK10F™ and a continuous phase of AF63™. As can be seen in Table I, FK10F™ and AF63™ have similar cobalt binder concentrations, however the average grain size of the tungsten carbide grains of the AF63™ grade is greater than the FK10F™ grade.

TABLE II

Hybrid Cemented Carbide having a Dispersed Phase of FK10F ™ and a Continuous Phase of AF63 ™

| Sample No. | Volume Fraction of Dispersed Phase | Wear Resistance ($10/mm^3$) | Palmquist Toughness ($Mpa \cdot \sqrt{m}$) | Hardness (HRA) | Contiguity Ratio of Dispersed Phase | 1.5 time the volume fraction of the dispersed phase |
|---|---|---|---|---|---|---|
| 1 | 0.075 | 1.61 | 12.2 | 90.1 | 0.05 | 0.113 |
| 2 | 0.18 | 1.72 | 10.5 | 90.4 | 0.12 | 0.27 |

As may be seen in Table II, embodiments of the hybrid cemented carbides prepared by the process of the present invention with the dispersed phase sintered at 1000° C. prior to blending using these conventional grades resulted in a favorable combination of the properties of each of the individual cemented carbide grades. In Sample No. 1, the hybrid cemented carbide included only 7.5 vol. % of the hard grade cemented carbide, FK10F™, however, the wear resistance increased more than 12% while the toughness only decreased 7.5%.

TABLE III

Hybrid Cemented Carbides Having a Dispersed Phase of FK10F ™ and a Continuous Phase of 2055 ™

| Sample No. | Volume Fraction of Dispersed Phase | Wear Resistance ($10/mm^3$) | Palmquist Toughness ($Mpa \cdot \sqrt{m}$) | Hardness (HRA) | Contiguity Ratio of Dispersed Phase | 1.5 time the volume fraction of the dispersed phase |
|---|---|---|---|---|---|---|
| 3 | 0.09 | 0.93 | 17.0 | 87.3 | 0.12 | 0.135 |
| 4 | 0.22 | 1.40 | 16.1 | 88.4 | 0.26 | 0.33 |
| 5 | 0.35 | 1.72 | 14.1 | 89.2 | 0.39 | 0.53 |

Figure 6A:
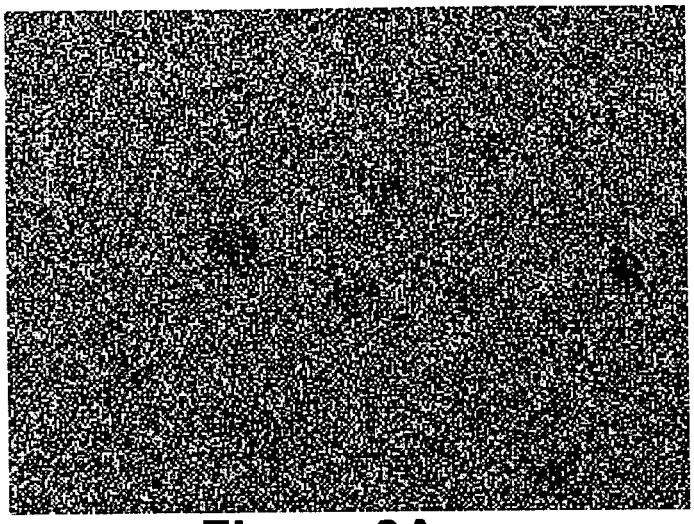
FIG. 6A is a photomicrograph of an embodiment of a hybrid cemented carbide having a volume fraction of the dispersed phase of 0.09 and a contiguity ratio of 0.12.
Figure 6B:
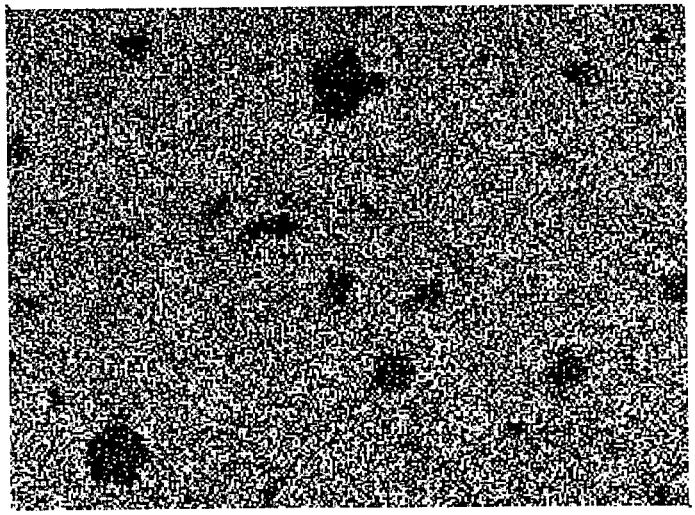
FIG. 6B is a photomicrograph of an embodiment of a hybrid cemented carbide with a similar composition of the dispersed phase and the continuous phase of the hybrid cemented carbide of FIG. 6A, however, the hybrid cemented carbide of FIG. 6B has a volume fraction of the dispersed phase of 0.22 and a contiguity ratio of 0.26.
Figure 6C:
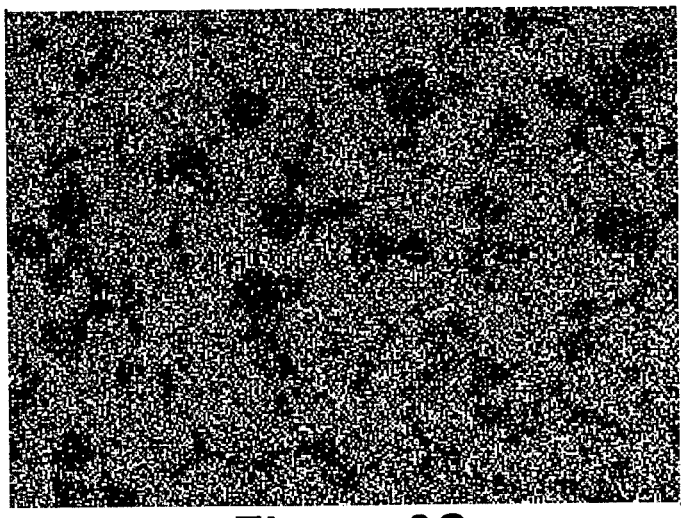
FIG. 6C is a photomicrograph of an embodiment of a hybrid cemented carbide with a similar composition of the dispersed phase and the continuous phase of the hybrid cemented carbide of FIG. 6A, however, the hybrid cemented carbide of FIG. 6C has a volume fraction of the dispersed phase of 0.35 and a contiguity ratio of 0.39.

Further embodiments of the hybrid cemented carbides were produced with a continuous phase of 2055™ grade cemented carbide. 2055™ is a tough grade of cemented carbide. Photomicrographs of the cross sections of each of the samples No. 3, 4, and 5 are shown in FIGS. 6A, 6B, and 6C, respectively. The contiguity ratio of each of these samples is shown in Table III. Sample No. 3 comprises only 9 vol. %. of the dispersed phase and FIG. 6A clearly show the dispersed phase as discrete regions. As the volume fraction increases to 22% and 35%, see FIGS. 6B and 6C and Table III, the properties of the hybrid cemented carbide begin to shift more toward the properties of the hard dispersed phase showing increases in wear resistance and hardness, but still maintain a relatively high toughness to retard crack propagation as in the continuous phase. The properties of the embodiments of the hybrid cemented carbides shown in Table III show that the wear resistance of the tough cemented carbide materials with small decreases in toughness.

TABLE IV

Hybrid Cemented Carbides Having a Dispersed Phase of FK10F ™ and a Continuous Phase of R-61 ™

| Sample No. | Volume Fraction of Dispersed Phase | Wear Resistance ($10/mm^3$) | Palmquist Toughness ($Mpa \cdot \sqrt{m}$) | Hardness (HRA) | Contiguity Ratio of Dispersed Phase | 1.5 time the volume fraction of the dispersed phase |
|---|---|---|---|---|---|---|
| 6 | 0.08 | 0.83 | 22.2 | 86.2 | 0.11 | 0.12 |
| 7 | 0.20 | 1.30 | 20.1 | 87.5 | 0.25 | 0.30 |
| 8 | 0.33 | 1.72 | 14.5 | 88.6 | 0.40 | 0.50 |

Further examples of embodiments of hybrid cemented carbides are shown in Tables IV with the properties of the hybrid cemented carbides. The embodiments of the samples of Table IV were prepared by blending sintered granules of FK10F™ with R-61™. R-61™ is a tougher grade of cemented carbides than AF63™ and 2055™. The results are surprising. The wear resistance of the hybrid cemented carbide increases significantly over the wear resistance of the continuous phase with only a small reduction in toughness. For instance, with 20 vol % of sintered FK10F™ added to R-61 ™, the wear resistance increases 78% while the toughness only decreases by 11%. The method of the present invention may result in significant improvements in the properties of cemented carbides.

TABLE V

Hybrid Cemented Carbides Having a Dispersed Phase of FK10F ™ and a Continuous Phase of H-25 ™

| Sample No. | Volume Fraction of Dispersed Phase | Wear Resistance ($10/mm^3$) | Palmquist Toughness ($Mpa \cdot \sqrt{m}$) | Hardness (HRA) | Contiguity Ratio of Dispersed Phase | 1.5 time the volume fraction of the dispersed phase |
|---|---|---|---|---|---|---|
| 9 | 0.07 | 0.8 | 33.0 | 82.2 | 0.09 | 0.11 |
| 10 | 0.17 | 1.04 | 29.3 | 84.1 | 0.21 | 0.26 |
| 11 | 0.30 | 1.15 | 24.6 | 86.5 | 0.35 | 0.45 |

Embodiments of the hybrid cemented carbides were also prepared using H-25™ as the continuous phase. The similarly surprising improvements in properties are shown in Table V.

Figure 7:
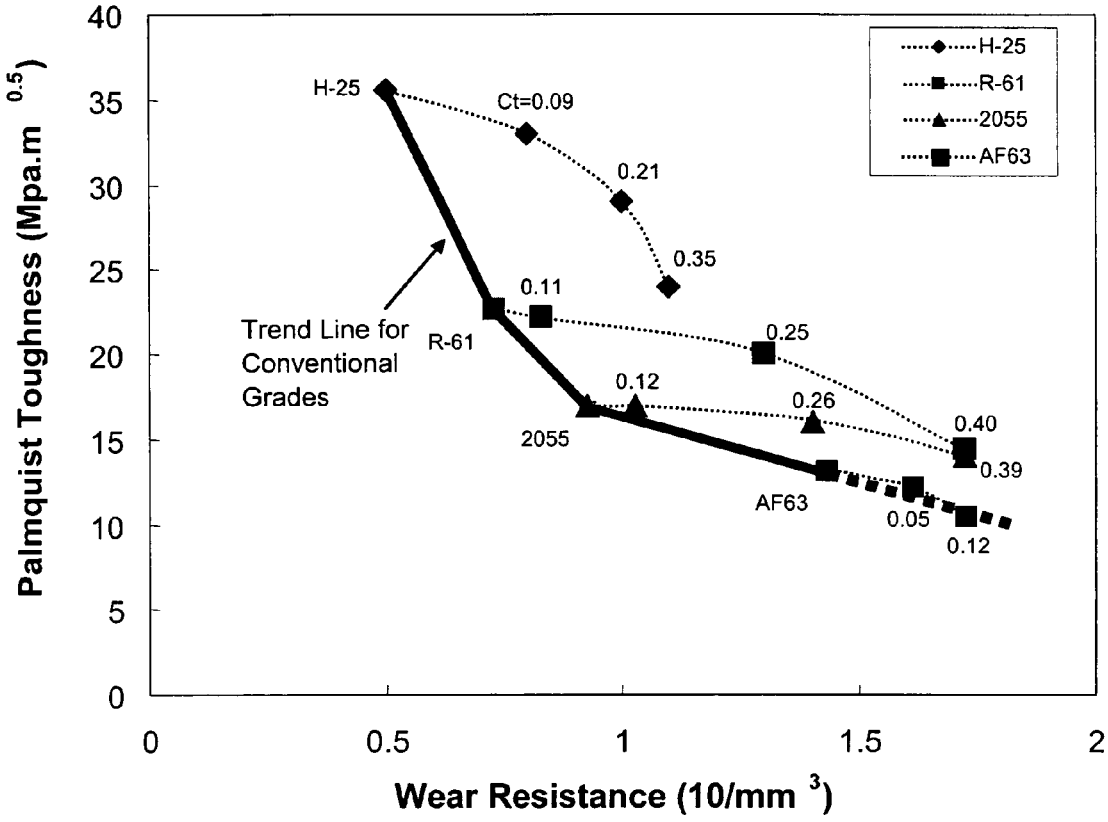
FIG. 7 is a graph showing the properties of conventional commercial grades of cemented carbides and several embodiments of the hybrid cemented carbides of the present invention comprising the conventional grades in the continuous phase and a relatively hard cemented carbide in the dispersed phase.

FIG. 7 is a plot of the data gathered from samples Nos. 1 through 11. As can readily be seen, hybrid cemented carbides prepared by the method of the present invention have improved combination of properties, toughness, and wear resistance. The composites of the present disclosure may be fabricated into articles particularly suited for a number of applications, for example, rock drilling (mining and oil/gas exploration) applications, as wear parts in machinery employed for construction, as roll materials in the hot rolling of steel and other metals, and in impact forming applications, e.g., cold heading, etc.

It is to be understood that the present description illustrates those aspects relevant to a clear understanding of the disclosure. Certain aspects that would be apparent to those skilled in the art and that, therefore, would not facilitate a better understanding have not been presented in order to simplify the present disclosure. Although the present disclosure has been described in connection with certain embodiments, those skilled in the art will, upon considering the foregoing disclosure, recognize that many modifications and variations may be employed. It is intended that all such variations and modifications be covered by the foregoing description and following claims.

For the purpose of this invention cemented carbides are defined as those comprising carbides of one or more of the transition metals, such as, but not limited to, titanium, chromium, vanadium, zirconium, hafnium, tantalum, molybdenum, niobium, and tungsten as the hard dispersed phase cemented together by cobalt, nickel, or iron or alloys of these metals as the binder or continuous phase. Additionally, the binder phase may contain up to 25% by weight alloying elements, such as, but not limited to, tungsten, titanium, tantalum, niobium, chromium, molybdenum, boron, carbon, silicon, and ruthenium, as well as others.

I claim:

1. A hybrid cemented carbide composite, comprising:

a cemented carbide dispersed phase; and a cemented carbide continuous phase, wherein the contiguity ratio of the dispersed phase is less than or equal to 0.48.

2. The hybrid cemented carbide composite of claim 1, wherein the contiguity ratio of dispersed phase is less than 0.4.

3. The hybrid cemented carbide composite of claim 2, wherein the contiguity ratio of the dispersed phase is less than 0.2.

4. The hybrid cemented carbide composite of claim 1, wherein the hardness of the dispersed phase is greater than the hardness of the continuous phase.

5. The hybrid cemented carbide composite of claim 1, further comprising:

a second cement carbide dispersed phase, wherein at least one of the composition and the properties of the second cemented carbide dispersed phase is different than the other cemented carbide dispersed phase, wherein the properties are selected from the group consisting of hardness, Palmquist Toughness, wear resistance, and combinations of any thereof.

6. The hybrid cemented carbide composite of claim 1, wherein the dispersed phase is between about 2 and about 50 percent by volume of the composite material.

7. The hybrid cemented carbide composite of claim 6, wherein the dispersed phase is between 2 and 25 percent by volume of the composite material.

8. The hybrid cemented carbide composite of claim 1, wherein the hardness of the dispersed phase is greater than or equal to 88 HRA and less than or equal to 95 HRA.

9. The hybrid cemented carbide composite of claim 8, wherein the Palmquist Toughness of the continuous phase is greater than 10 $Mpa.m^{1/2}$.

10. The hybrid cemented carbide composite of claim 8, wherein the hardness of the continuous phase is greater than or equal to 78 and less than or equal to 91 HRA.

11. The hybrid cemented carbide of claim 1, wherein the cemented carbides of the dispersed phase and the cemented carbides of the continuous phase independently comprise at least one of carbides of at least one transition metal selected from the group consisting of titanium, chromium, vanadium, zirconium, hafnium, tantalum, molybdenum, niobium, and tungsten and a binder comprising at least one selected from the group consisting of cobalt, nickel, iron, and alloys of cobalt, nickel, and iron.

12. The hybrid cemented carbide of claim 11, wherein the binder further comprises an alloying agent selected from the group consisting of tungsten, titanium, tantalum, niobium, chromium, molybdenum, boron, carbon, silicon, and ruthenium.

13. The hybrid cemented carbide composite of claim 12, wherein the binder concentration of the dispersed phase is between about 2 wt % and about 15 wt % and the binder concentration of the continuous phase is between about 6 wt % and 30 wt %.

14. The hybrid cemented carbide composite of claim 11, wherein the cemented carbide dispersed phase comprises tungsten carbide and cobalt and the cemented carbide continuous phase comprises tungsten carbide and cobalt.

15. A hybrid cemented carbide composite, comprising:

a first cemented carbide dispersed phase wherein a volume fraction of the dispersed phase is less than 50 volume percent; and a second cemented carbide continuous phase, wherein the dispersed phase has a contiguity ratio less than or equal to 1.5 times the volume fraction of the dispersed phase in the composite.

16. The hybrid cemented carbide composite of claim 15, wherein the first cemented carbide and the second cemented carbide independently comprise at least one of carbides of at least one transition metal selected from the group consisting of titanium, chromium, vanadium, zirconium, hafnium, tantalum, molybdenum, niobium, and tungsten and a binder comprising at least one selected from the group consisting of cobalt, nickel, iron, and alloys of cobalt, nickel, and iron.

17. The hybrid cemented carbide composite of claim 16, wherein the binder further comprises an alloying agent selected from the group consisting of tungsten, titanium, tantalum, niobium, chromium, molybdenum, boron, carbon, silicon, and ruthenium.

18. The hybrid cemented carbide composite of claim 15, having a wear resistance greater than 0.7 $10/mm^3$ and a Palmquist toughness greater than 10 $Mpa.m^{1/2}$.

19. The hybrid cemented carbide composite of claim 18, having a Palmquist toughness greater than 20 $Mpa.m^{1/2}$.

20. The hybrid cemented carbide composite of claim 15, wherein the dispersed phase has a contiguity ratio of less than or equal to 0.48.

21. The hybrid cemented carbide composite of claim 20, wherein the contiguity ratio of the dispersed phase is greater than 0 and less than or equal to 0.4.

22. The hybrid cemented carbide composite of claim 21, wherein the contiguity ratio of the first phase is greater than 0 to about 0.3.

* * * * *